United States Patent [19]

Allard et al.

[11] Patent Number: 4,765,553

[45] **Date of Patent: * Aug. 23, 1988**

[54] WINDING APPARATUS

[75] Inventors: Vincent L. Allard, Staines; Henry Gallard, Perivale, both of England

[73] Assignee: BICC Public Limited Company, London, England

[ * ] Notice: The portion of the term of this patent subsequent to Nov. 24, 2004 has been disclaimed.

[21] Appl. No.: 64,935

[22] Filed: Jun. 22, 1987

Related U.S. Application Data

[63] Continuation of Ser. No. 746,108, Jun. 18, 1985, Pat. No. 4,708,298.

[30] Foreign Application Priority Data

Jun. 20, 1984 [GB] United Kingdom ..... 8415732

[51] Int. Cl.[4] ..... B65H 67/048

[52] U.S. Cl. ..... 242/25 A; 242/78

[58] Field of Search ..... 242/25 A, 25 R, 18 A, 242/18 R, 18 PW, 35.5 R, 35.5 A, 78, 80

[56] References Cited

U.S. PATENT DOCUMENTS

| | | | |
|---|---|---|---|
| 2,321,646 | 6/1943 | Blodgett | 242/25 A |
| 2,868,468 | 1/1959 | Bunch | 242/25 A |
| 3,026,010 | 3/1962 | Crosby et al. . | |
| 3,259,336 | 7/1966 | Hibbard | 242/158 R |
| 3,420,459 | 1/1969 | Peters | 242/25 A |
| 3,421,709 | 1/1969 | Breacker et al. | 242/64 |
| 3,806,051 | 4/1974 | Camardella | 242/7.11 |
| 3,833,184 | 9/1974 | Hara et al. | 242/158 R |
| 3,895,762 | 7/1975 | Fletcher, Jr. et al. | 242/25 R X |
| 3,913,858 | 10/1975 | Ikegami | 242/25 A |
| 3,951,355 | 4/1976 | Morioka et al. | 242/158 R |
| 4,007,885 | 2/1977 | Hare et al. | 242/43 R |
| 4,147,310 | 4/1979 | Harden et al. | 242/25 A |
| 4,708,298 | 11/1987 | Allard et al. | 242/25 A |

FOREIGN PATENT DOCUMENTS

| | | |
|---|---|---|
| 0031783 | 12/1980 | European Pat. Off. . |
| 2168645 | 8/1973 | France . |
| 2428483 | 6/1978 | France . |
| 1275519 | 5/1972 | United Kingdom . |

*Primary Examiner*—Stanley N. Gilreath

*Attorney, Agent, or Firm*—Anthony J. Casella; Gerald E. Hespos

[57] ABSTRACT

Apparatus for winding cable on to a spool comprises a movable table (11) on which at least three spools may be located. The table is mounted substantially horizontally such that the spools may be located thereon with their longitudinal axes substantially vertically upright. The table is movable between three positions; a loading position (12) where an empty spool is loaded on to the table; a winding position (13) where a spool is rotated and cable (2) is wound on to the spool; and an unloading position (14) where a wound spool is removed from the table. There is also provided first lifting means (15) for loading a spool on to the table, second lifting means (16) for removing a spool from the table, means (30) for loading the cable on to a spool, means (38) for cutting the cable, and a programmable controller adapted to control the sequence of operations.

8 Claims, 12 Drawing Sheets

25
23
22
14
21
27
26
24
26
13
21
26
11
12
26
21

WINDING APPARATUS

This application is a continuation of U.S. patent application Ser. No. 746,108 which was filed on June 18, 1985 now U.S. Pat. No. 4,708,298.

This invention relates to apparatus for winding electric cable, electric conductor, pipe or other flexible elongate member (hereinafter for convenience referred to as "cable") onto a spool.

It is an object of the present invention to provide apparatus for automatically winding cable onto a spool on a substantially continuous basis.

According to the present invention, apparatus for winding cable onto a spool comprises a winding station comprising a movable table on which at least three spools may be located, the table being mounted substantially horizontally such that the spools may be located thereon with their longitudinal axes substantially vertically upright; means for loading a spool onto the table; means for removing a spool from the table; means for cutting the cable; means for loading the cable onto a spool; and a programmable controller; wherein the table is movable through at least three positions: a loading position where an empty spool is loaded onto the table by the spool loading means; a winding position where a spool is rotated and cable is wound onto the spool; and an unloading position where a wound spool is removed from the table by the spool removal means.

This apparatus operates in the following manner:

Step 1

Cable is fed from an input (for example an extruder, stranding apparatus, payoff stand, etcetera) onto a spool at the winding position on the table. Substantially simultaneously a previously wound spool is removed from the unloading position by the spool removal means and an empty spool is placed on the table at the loading position by the spool loading means.

Step 2

After a predetermined length of cable has been wound onto the spool at the winding position, the cable cutting means cuts the cable, and the end of the cable on the input side is secured by the cable loading means.

Step 3

The table is moved to bring the empty spool from the unloading position to the winding position and move the wound spool from the winding position to the unloading position.

Step 4

The cut end of the cable is secured on the empty spool now at the winding position by the cable loading means and winding is re-started.

Steps 1 to 4 are then repeated, the controller having been programmed to control the sequence of operations.

Where the cable is fed substantially continuously from an input, preferably an accumulator is positioned between the input and the winding station, the cable being fed through the accumulator. During Step 2, after the cable has been cut, and the ends secured, the cable still being fed from the input is stored in the accumulator until winding is re-started.

The programmable controller is preferably a microprocesssor or microcomputer.

Each spool preferably comprises a longitudinally extending, substantially hollow barrel with a flange at each end of the barrel, extending outwardly away from the spool. Alternatively the spool may comprise a barrel with only one flange (a "dummy" spool). In this case, the spool can be removed to leave a coil of cable. In both cases the spools are mounted on the table with the longitudinal axis of the barrel substantially vertical.

Preferably the table is substantially circular and rotates about an axis passing through the centre of the circle, normal to the surface of the table, and preferably the table has at least three rotatable mounting plates on which the spools can be mounted. Where the spools are small, or have a restricted barrel diameter, preferably each mounting plate comprises tapered pintles which can engage in openings in the lower flange of the spool. Where the spools have a larger diameter barrel, each mounting plate preferably comprises an expandable mandrel engagable with the inner surface of the barrel of the spool. When a spool is in the winding position, preferably a pintle or mandrel is also positioned in the top of the spool. Where the spool only has one flange, the upper pintle or mandrel preferably also includes a plate which acts as the upper flange of the spool. Each mounting plate preferably has a friction plate which can be engaged, in the winding position, by a second friction plate rotatably driven by a motor, the rotatable axes of the friction plates being aligned. Preferably the motor driving the spool in the winding position also rotates the table. The drive to the table preferably includes a belt and clutch, the clutch being disengaged while the spool is being rotated in the winding position, and a toothed wheel which engages corresponding teeth mounted on the periphery of the table. Suitable alternative drive means may be used rather than friction plates, for example interengaging cog wheels attached to the mounting plates and the motor. Preferably a brake acting on the mounting plate stops the rotation when the pre-determined length of cable has been wound onto the spool at the winding position.

Where the mounting plate comprises pintles, preferably the table comprises, at the unloading position, rotation means for rotating the mounting plate (after the wound spool is removed) to ensure the pintles are in the required position for alignment with the openings in the empty spool to be loaded onto the table. Preferably the rotation means comprises a motor and friction plate for engaging the friction plate of the mounting plate.

The spool loading means preferably comprises an arm which is attached at one end to a longitudinally extending substantially vertical column, the arm being substantially perpendicular to the column, rotatable about the longitudinal axis of the column, and movable in a vertical direction, the free end of the arm having means for securing a spool. Preferably the spool securing means comprises at least three pivotable limbs each of which has a ledge at its free end for engaging behind a flange of the spool, at the perimeter of the flange. Alternatively the spool securing means comprises at least three pivotable fingers, each of which has an edge at its free end for engaging behind the upper flange of the spool inside the barrel of the spool. As an alternative, the spool securing means may comprise a vacuum means which engages the upper flange of the spool, in the case of a spool having two flanges. As a still further alternative, the spool securing means may comprise an expanding mandrel which engages the inner surface of the barrel of the spool. The spool removal means is preferably the same as the spool loading means. Suitable spool loading means and spool removal means are described in more detail in our U.S. patent application Ser. No. 745 887 filed the same day as U.S. patent application Ser. No. 746,108.

The cable cutting means preferably comprises two pivotable knives which are operated by hydraulic or pneumatic means in a scissor-like action.

Preferably the cable loading means comprises a pivotable tube through which the cable passes, cable clamping means, and cable bending means. The pivotable tube is normally situated in a first position which helps to ensure correct feed of the cable onto the spool, and pivots away from the spool barrel as each layer is wound onto the spool. Once a predetermined length of cable has been wound onto the spool, the cable feed to the tube is stopped (either by stopping the input or by actuating the accumulator where present), the cable clamp means clamps the cable, and the cable cutting means (which, with the tube in its first position, is situated between the tube and the spool) cuts the cable. After the full spool has been removed and an empty one placed in position for winding, the tube moves to a second position such that its output end is adjacent the barrel of the spool. The cable bending means bends a portion of the free end of the cable projecting from the tube at substantially right angles to the longitudinal axis of the cable. The bent portion of the cable is positioned to extend beyond the full traverse of the cable to be wound (and through an aperture in the upper flange of the spool, where present, or through an aperture in the plate defining the upper flange, where present) with the axis of the bent portion substantially parallel to the longitudinal axis of the barrel of the spool. Where the table has an upper pintle or mandrel at the winding position, preferably the upper pintle or mandrel also includes a piston which has a gripping surface and which is movable to grip the free end of the bent portion of the cable between the gripping surface and a fixed surface. Preferably the piston is pneumatically activated. By gripping the free end of the bent portion, the risk of pulling the cable back through the aperture during winding is removed. With this arrangement, this (bent) end of the cable is exposed for testing purposes if required. The tube is then moved back to its first position, the cable feed to the tube is then re-started, and winding of the cable to the empty spool started. All movements of the tube are preferably pneumatically controlled. Preferably the tube traverses the spool during winding, when the tube is in the first position. The cable clamp is preferably situated at or near the input end of the tube, and preferably comprises a piston which has a serrated gripping surface and which is movable to grip the cable between the serrated surface and a fixed surface. The piston is preferably pneumatically operated. The cable clamping means may be integrally attached to the input end of the tube or may be independently mounted.

In the former case, the cable clamping means is released when the tube has moved from its second position to its first position. In the latter case, the cable clamping means is released before the tube is moved from its second position to its first position. The cable bending means is preferably attached to the output end of the tube, and preferably comprises a pivotable bending arm which can move from an unengaged position substantially parallel to the longitudinal axis of the tube across the output end of the tube (engaging the free end of the cable projecting therefrom) to an engaged position substantially perpendicular to the longitudinal axis of the tube (thereby bending the portion of the free end of the cable through an angle of 90°) and then back to its unengaged position. Preferably the movement of the bending arm is pneumatically controlled.

Preferably the spool is rotated by alignment means until it is in a predetermined rotationally aligned position. This ensures that, where the mounting plate comprises pintles, the spool is aligned such that the pintle receiving openings therein are in a position for location with the pintles. Furthermore the spool is aligned to ensure that the aperture in the upper flange of the spool (if provided) is in the required position for cable insertion. Preferably the alignment means comprises a drive wheel which engages the barrel of the spool and a resiliently mounted plunger. In this arrangement the drive wheel rotates the spool until the plunger engages in the aperture preventing further rotation. The drive wheel is preferably rotated by a motor. Preferably the plunger includes sensing means which, when the plunger engages the aperture, disconnects the power to the motor rotating the drive wheel. The alignment means is preferably positioned downstream of the loading position on the table.

The apparatus preferably comprises tag insertion means and tag bending means. The tag insertion means inserts one end of a tag as the last layer of the cable is wound onto the spool, between the last layer of the cable and the preceding layer through at least the last two turns of cable and, after completion of winding, the tag bending means bends the other end of the tag over to secure the final turn of the cable to the spool. The tag insertion means is preferably movably attached to the pivotable tube (where present), and during the winding of the last layer of the cable, the tag insertion means moves along the tube and inserts one end of a tag, and then moves back. The tag insertion means preferably comprises a pair of nippers which clamp a tag and position it as required, and a dispenser for feeding the tags to the nippers. The tag dispenser preferably comprises a reel of tag material and drive, clamping and cutting means. The drive clamping and cutting means preferably comprises a drive wheel for feeding the tag material from the reel, a movable clamp for gripping the tag material at or adjacent its free end, and shears for cutting the tag material. In this arangement, the movable clamp grips the tag material and moves in a direction to pull a predetermined length of the material through the dispenser, the shears cut the material, the movable clamp continues to move in the same direction to a position where the nippers grip the cut tag and the movable clamp releases it, the movable clamp then moves back and in moving back acts on the drive wheel to feed the free end of the uncut tag material to a position for gripping by the movable clamp. Preferably an adhesive applicator applies adhesive (preferably a pressure-sensitive adhesive) to one side of the tag whilst it is moved by the movable clamp. The adhesive assists in securing the tag in position, thereby assisting in securing the final turn of cable.

A second clamp preferably secures the free end of uncut tag material while the movable clamp grips the cut tag. The dispenser preferably includes straightening rollers through which the tag material passes, a dancer arm over which the tag material passes before entering the drive, clamping and cutting means, and a brake acting on the reel. The dancer arm and brake prevent over rotation of the reel and maintain a required tension in the tag material. The clamp (or clamps) are preferably piston actuated. The drive wheel has to be free wheeling in one direction, and is rotated in the other direction by the movement of the movable clamp. The tag insertion means is preferably pneumatically operated. The tag bending means preferably comprises a rod which extends longitudinally along an axis parallel to the longitudinal axis of the barrel of the spool, which can move from a non-actuating position to an actuating position adjacent the spool, and which has a projection mounted on it, the projection being movable along the rod and extending towards the spool. After a tag has been inserted in position, the rod is moved from its non-actuating position to its actuating position, and the projection moves along the rod to engage the other end of the tag and bend it over. The rod is then moved back to its non-actuating position. Preferably the movement of the tag bending means is controlled pneumatically. The tags are preferably of cardboard, although suitable alternatives such as aluminium (alloy) or thin mild steel may be used.

The apparatus preferably also comprises a test station for testing cables after winding and after removal from the table. A suitable test station is described in our U.S. Pat. No. 4,670,707, filed the same day as U.S. patent application Ser. No. 746,108.

Where the spool comprises only one flange, the apparatus preferably also comprises means for removing the wound cable from the "dummy" spool. A suitable apparatus is described in our patent application Ser. No. 746,182 filed the same day as U.S. patent application Ser. No. 746,108.

Length measuring means is preferably positioned between the input (or accumulator where present) and the table. After the predetermined length of cable has passed from the length measuring means, a signal is transmitted components of the apparatus as required.

The length measuring means preferably comprises two caterpillar tracks which are resiliently mounted on wheels to engage the cable, which passes between them. This caterpillar arrangement provides an accurate determination of the length of cable which passes. One of the wheels is connected to length monitoring means which provides the necessary activation signal.

Lump removal means is preferably positioned between the input (or accumulator where present) and the table. The cable passes through the lump removal means which flattens any imperfections in the cable surface.

Cable twisting means is preferably positioned between the input (or accumulator where present) and the table which can twist the cable through substantially 90. This is especially necesary when flat cable is wound from a pay-off stand onto spools. Preferably the cable twisting means comprises two pulleys over which the cable passes, the pulleys being spaced apart and mounted substantially perpendicular to one another.

Preferably a resiliently mounted dancer arm is positioned between the input (or accumulator where present) and the table, and which acts on the cable. The dancer arm allows for small movements of the cable loading means, for example when the free end of the cable is positioned in the aperture in the spool. Preferably the dancer arm has a pulley over which the cable passes, and preferably this pulley is one of the pulleys of the cable twisting means, where present.

The length measuring means, lump removal means, cable twisting means and dancer arm are preferably all mounted on a single framework.

The apparatus preferably further comprises means for removing spools (or coils) containing faulty cable; means for the packaging of wound spools or coils; and/or means for the stacking of wound spools or coils onto pallets.

In an alternative arrangement, at the winding station the loading and unloading positions may be the same, and only one spool loading/removal means is required which carries out both tasks sequentially.

This invention also includes a method of winding cable onto a spool as herein described. In particular a method of winding cable on to a spool includes the steps of loading an empty spool on to one of at least three locations on a movable table such that the longitudinal axis of the spool is substantially vertically upright, moving the table to take the spool into a winding position, loading cable on to the spool, rotating the spool to wind cable thereon, cutting the cable and securing the free end thereof, moving the table to take the spool into an unloading position, and lifting the spool from the table with lifting means.

The invention will now be further described, by way of example only, with reference to the accompanying drawings in which.

Figure 1:
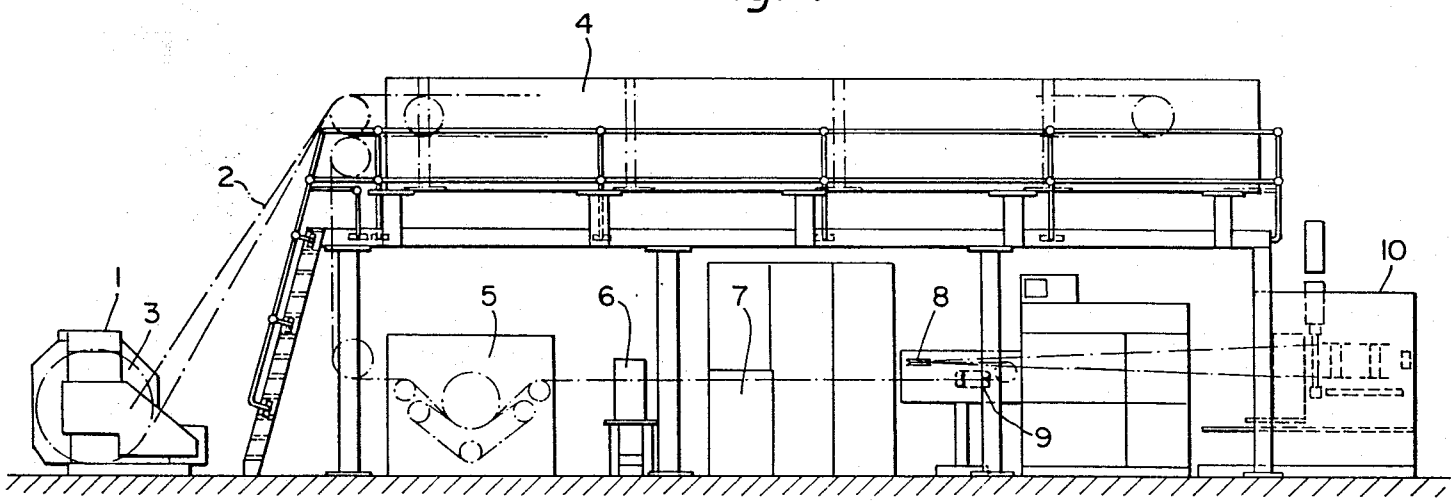
FIG. 1 is a general view of a table winding line incorporating apparatus in accordance with the invention.

Referring to FIG. 1 a dispatch winding line comprises a pay-off stand shown generally at 1 at which cable 2 is fed from a drum 3 to an overhead accumulator 4. A capstan 5 pulls the cable from the exit of accumulator 4 and feeds it through a spark test unit 6, cable cutter 7, knot cutter 8, measuring caterpillar 9 and on to a winding station 10 to be described in more detail with reference to the remainder of the figures.

Figure 2:
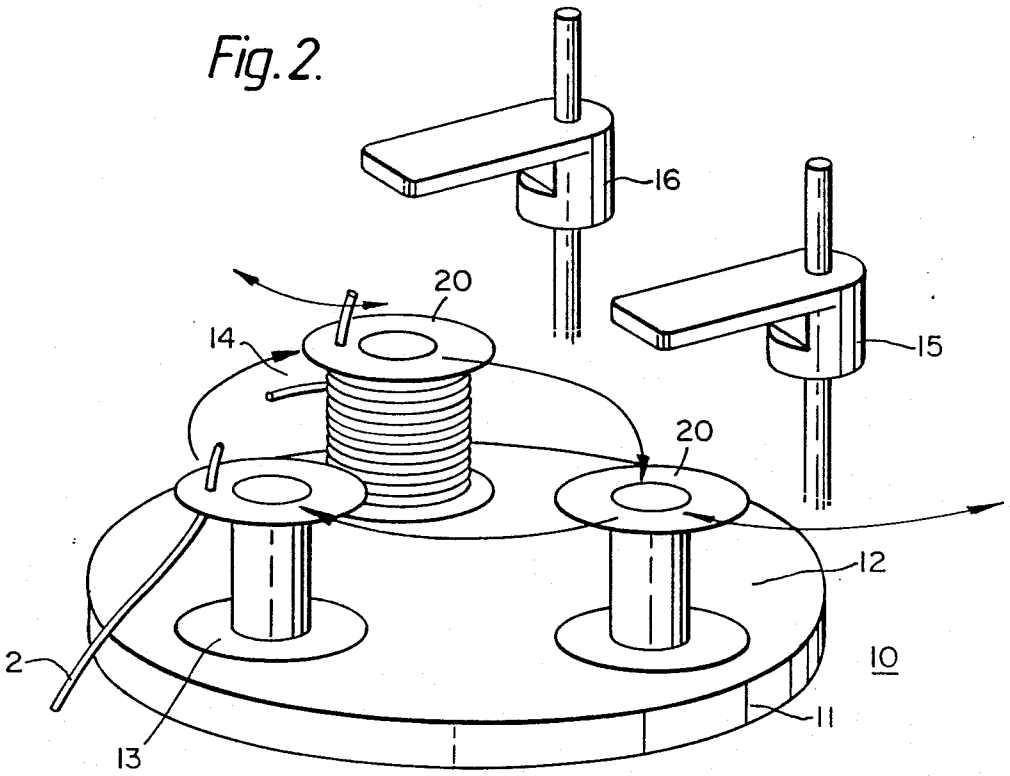
FIG. 2 is a schematic diagram of a winding station in accordance with the invention.

As shown in FIG. 2 the winding station 10 comprises a circular table 11, rotatable about a central axis, and having three spool positions; a loading position 12 where an empty spool 20 is loaded on to the table, a winding position 13 in which the spool 20 can be rotated to wind the cable 2 thereon, and an unloading position 14 in which the now full spool is unloaded from the table. Spool loading means 15 and spool unloading means 16, shown only schematically in FIG. 2, lift spools 20 on to and from the table respectively.

Figure 3:
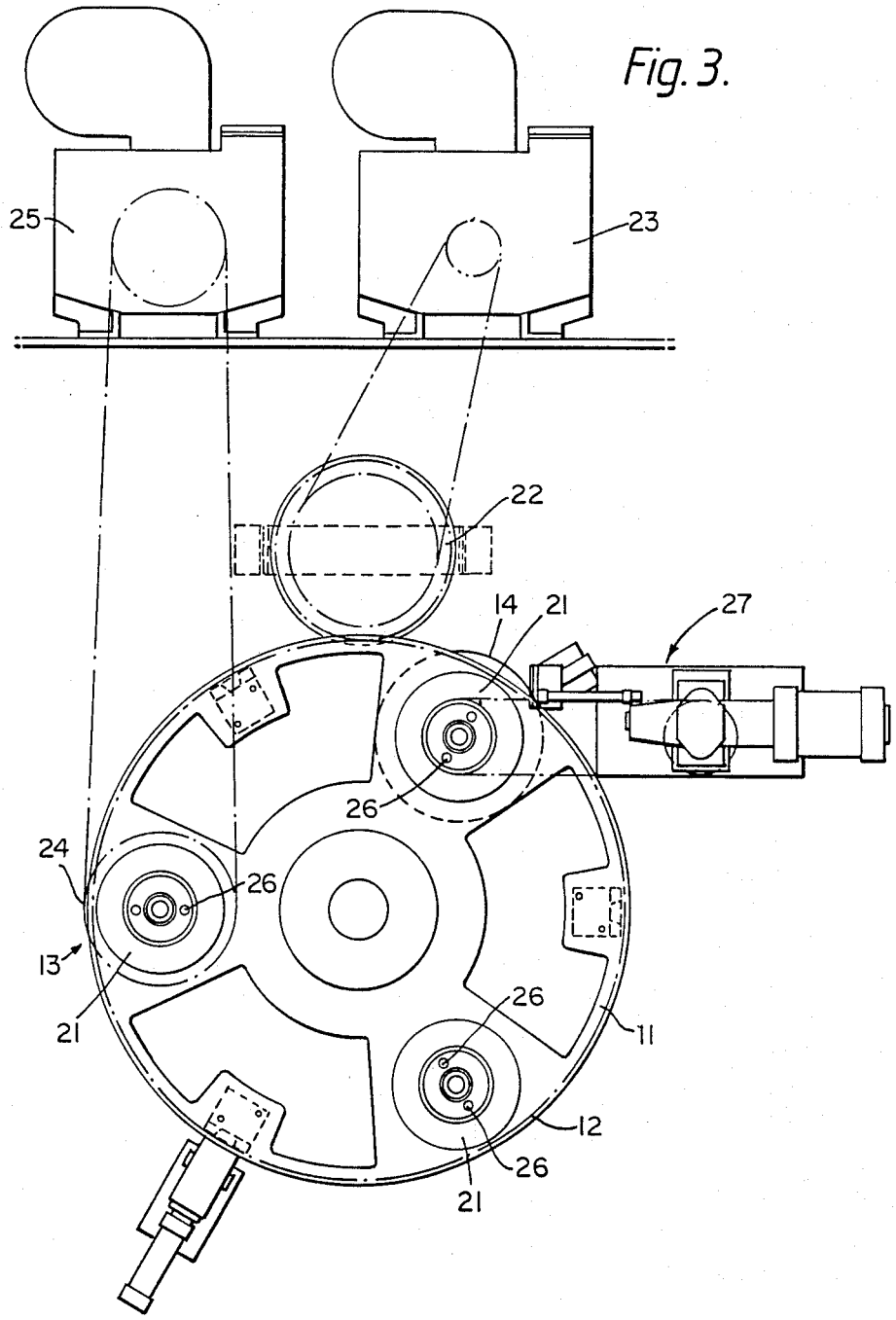
FIG. 3 is a plan view of a winding table forming part of the winding station of FIG. 2.

FIG. 3 shows the table 11 in more detail. Three mounting plates 21 are spaced around the circumference of the table, one in each of the loading, winding and unloading positions 12, 13 and 14. An indexing wheel 22, driven by a belt drive from a motor 23, rotates the table when required, such that the mounting plates 21 may be moved sequentially through the positions 12, 13 and 14. A rotatable friction plate 24, driven by a belt drive from a motor 25, is located under the table at the winding position 13. When rotated the friction plate 24 engages a complimentary friction plate (not shown) attached to each of the mounting plates 21 to rotate the mounting plate in the winding position 13.

Each of the mounting plates 21 carry pintles 26 on which a spool 20 may be located. A reset assembly, shown generally at 27, is provided at the unloading position 14 to reset the mounting plate such that the pintles 26 are in the required position to receive the next spool. The operation of the reset assembly 27 will be described in more detail later with reference to FIG. 13.

Figure 4:
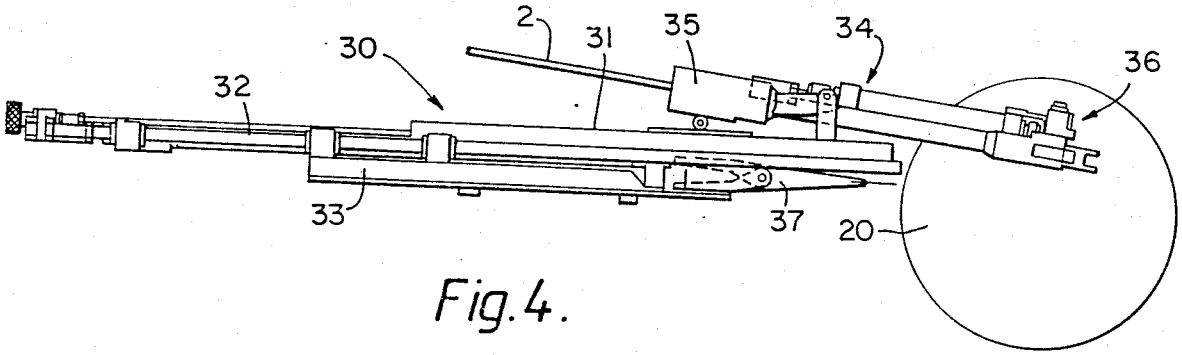
FIG. 4 is a plan view of a traversing arm adapted to feed cable to the winding station of FIG. 2, the arm being shown in a cable loading position.

In FIG. 4 a traversing arm shown generally at 30 comprises a frame 31 having fixedly secured thereto a pair of rods 32 on which is slidably mounted a carriage 33. Pivotably mounted on the frame 31 is a cable feed tube, shown generally at 34, and including a cable clamp portion 35 and a cable bending portion 36. The cable feed tube 34 will be described in more detail with reference to FIG. 8.

The carriage 33, which is movable along the rods 32 by means of a hydraulic cylinder (not shown) supports a tag dispenser 37. The whole of the traversing arm 30 is itself telescopically mounted on a guideway (not shown) to allow it to be extended into the position shown in FIG. 4 where it is adjacent spool 20.

In use an empty spool 20 is placed on to the table at the loading position 12 by the spool loading means 15 and the table is indexed to bring the spool into the winding position 13. The cable bending portion 36 takes the end of the cable 2 and bends it upwardly so that it projects through an aperture in the flange of the spool 20. The projecting end may also be gripped by an upper pintle (not shown) in order to prevent it from being pulled back through the aperture during winding.

Figure 5:
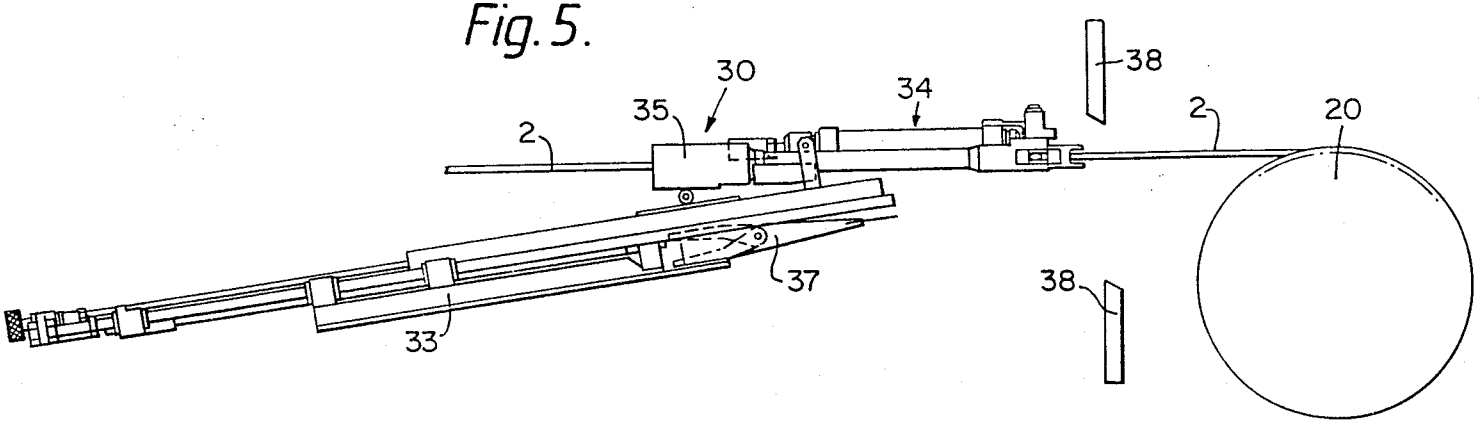
FIG. 5 is a plan view of the traversing arm of FIG. 4, the arm being shown in a cable winding position.
Figure 6:
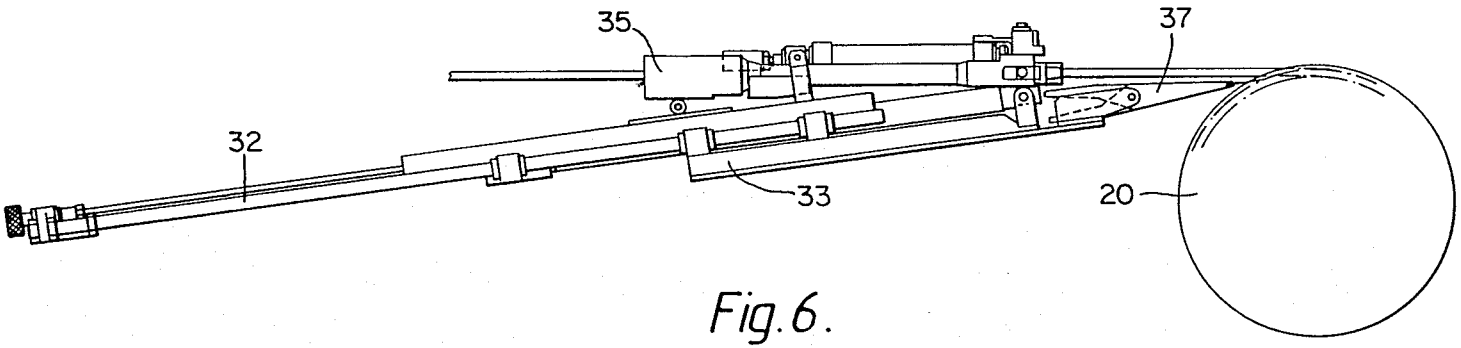
FIG. 6 is a plan view of the traversing arm of FIG. 4, the arm being shown in a cable securing position.

Once the cable end has been inserted on to the spool 20 the traversing arm 30 is withdrawn into the position shown in FIG. 5. The spool 20 is rotated by the motor 25 (see FIG. 3) and cable is wound on to the spool, the arm 30 and the guideway (not shown) to which the arm 30 is telescopically mounted traversing up and down as the cable 2 lays up on the spool. When the desired length of cable has been wound, the carriage 33 is moved along the rods 32 so that the tag dispenser 37 can insert a securing tag to the wound cable to prevent it from becoming unravelled. This is the situation as shown in FIG. 6.

After insertion of a tag the carriage 33 returns to its original position as shown in FIG. 5, and the cable clamp portion 35 operates to grip the cable 2. Cutting shears 38 sever the cable and the table is rotated to take the full spool to the unloading position 14, and bring the next empty spool into the winding position 13. The cable is inserted on to the spool as shown in FIG. 4, the cable clamp portion 35 releases the cable and the winding procedure is repeated.

Figure 7:
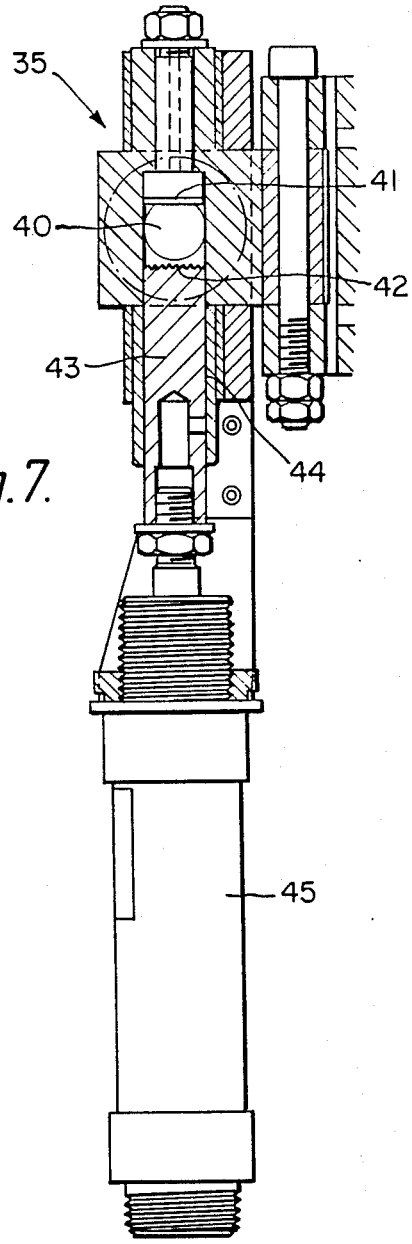
FIG. 7 is a sectional view along the line A—A through a part of the arm of FIG. 4, showing cable clamping means.

FIG. 7 shows in more detail the portion of the cable feed tube 34 constituting the cable clamp 35. The tube comprises a bore 40 through which the cable 2 is fed for winding, therebeing present at the clamping position 35 a planar surface 41 adjacent the bore on one side thereof, and a serrated gripping surface 42 on the other side thereof. The serrated surface 42 is a part of a piston 43, slidable in a slot 44 under the influence of a hydraulic cylinder 45. On actuation of the cylinder 45 the piston 43 moves in the slot 44 to close the bore 40 and grip the cable 2 between the surfaces 41 and 42.

Figure 8:
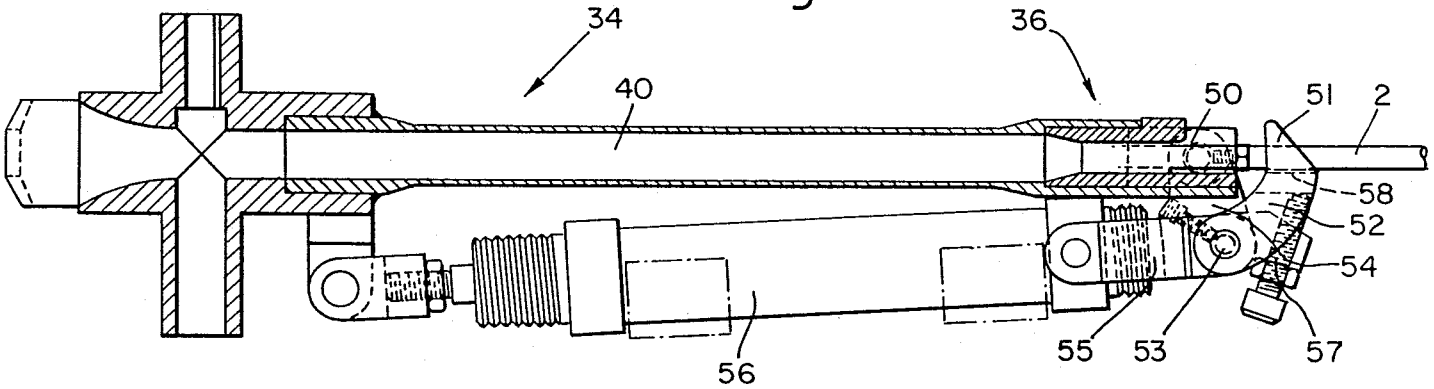
FIG. 8 is a side view, shown partly in sections, of a part of the arm of FIG. 4 constituting cable bending means, whilst

FIG. 8 shows the cable feed tube, with special regard to the cable bending portion 36. The cable 2 passes through the central bore 40 and emerges from the output end 50 of the tube 34, passing through the central recessed portion 51 of a U-shaped finger 52. The finger is connected at the pivot 53 of a linkage system formed by link members 54 and 55. One link member 54 is pivotally connected to the output end 50 of the tube, the other 55 being connected to the body of the tube 34 via a hydraulic cylinder 56. Adjustment of the finger 52 may be carried out by means of adjustment screw 57.

Figure 8A:
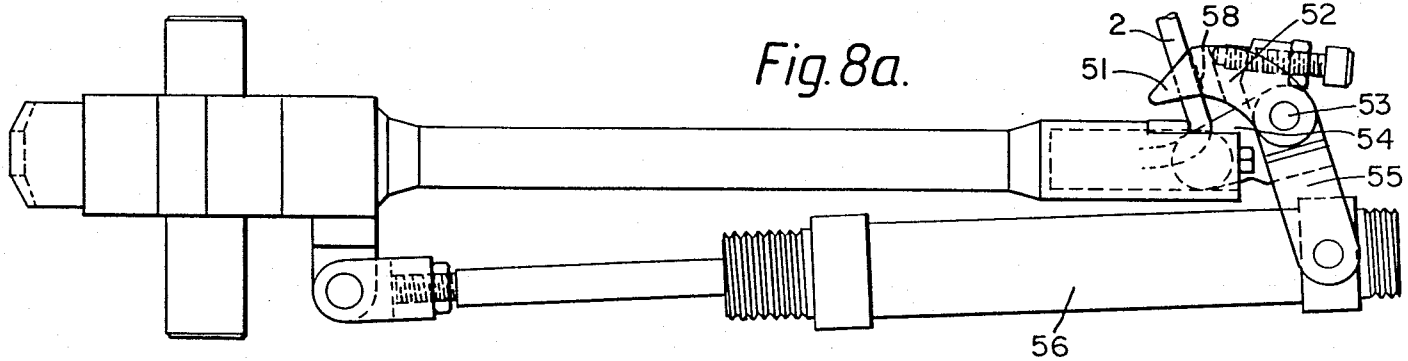
FIG. 8*a* shows the cable bending means in an actuated position.

To bend the cable 2 prior to insertion into the aperture in the flange of a spool, the hydraulic cylinder 56 is actuated, moving the link members 54 and 55 and pivoting the finger 52 upwardly. The cable is pushed upwards by contact with the surface 58 at the bottom of the U-shaped recess 51 until it is bent upwards as shown in FIG. 8*a*.

Figure 9:
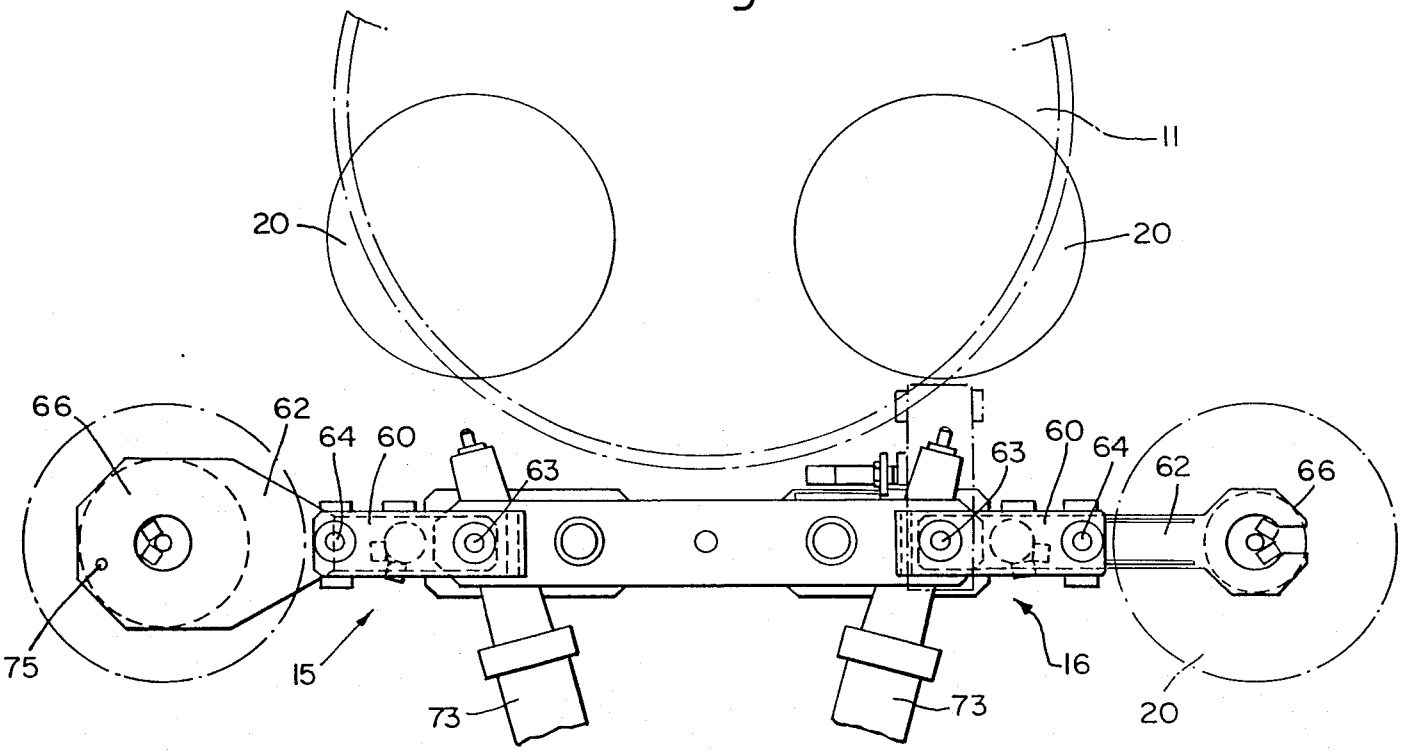
FIGS. 9 and 10 are plan and sectional side views respectively of the spool loading and unloading means of FIG. 2.
Figure 10:
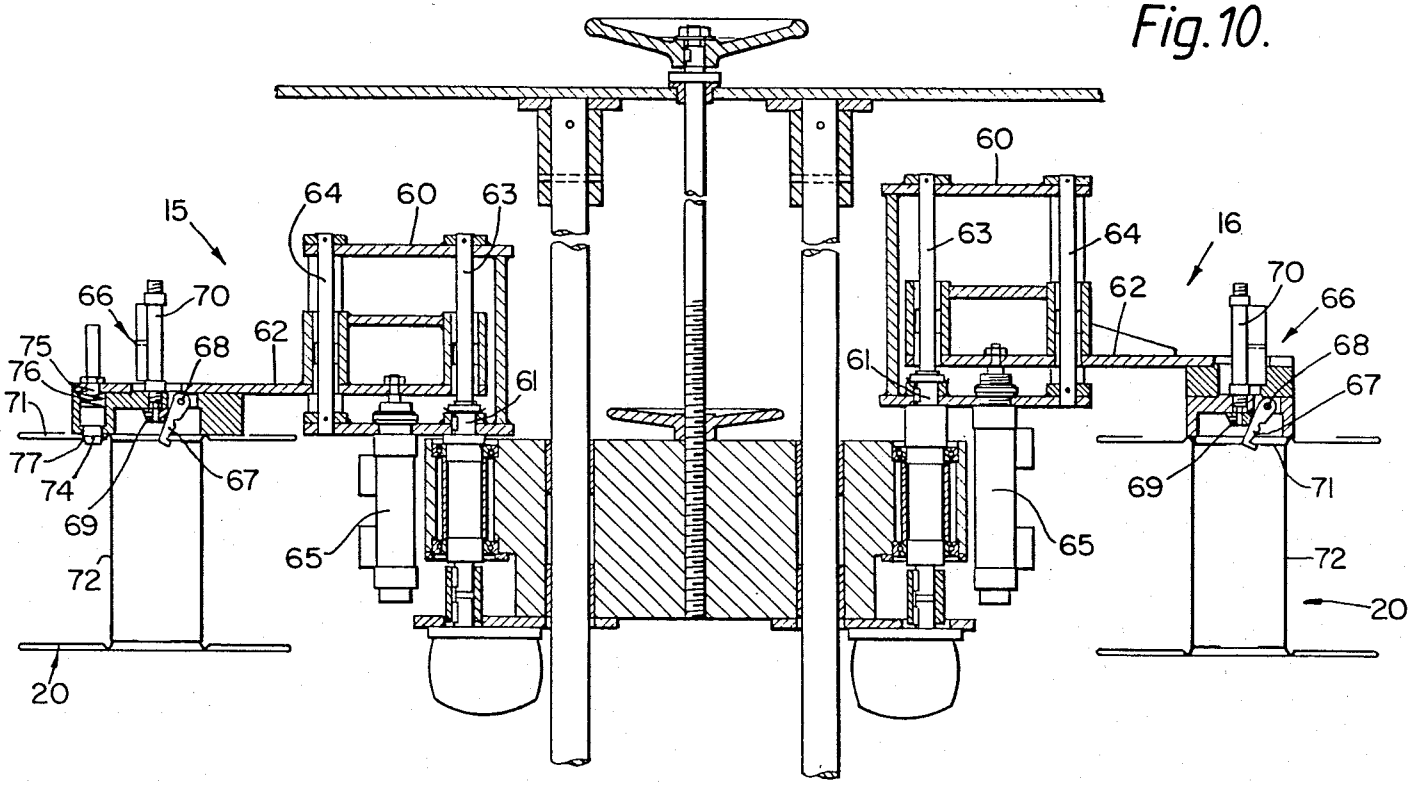

FIGS. 9 and 10 show one embodiment of spool loading and unloading means as described in our copending U.S. patent application Ser. No. 745 887. The spool loading means shown generally at 15, and spool unloading means shown generally at 16 are substantially similar one to the other, and each comprise a frame 60 rotatably mounted about a stem 61. Each frame 60 includes an arm 62 vertically movable along shafts 63, 64 by means of a hydraulic cylinder 65.

At the end of each arm is spool gripping means shown generally at 66 and comprising a plurality of pivotable fingers, one of which is shown in FIG. 10 at 67. The fingers 67 are movable about their pivot points 68 by means of a cam surface 69 movable vertically by the action of a hydraulic cylinder 70. Pivoting of the fingers 67 causes them to grip under the upper flange 71 of the spool 20 inside the barrel 72 thereof. Subsequent lifting of the arm by the hydraulic cylinder 65 accordingly lifts the spool 2, allowing it to be pivoted on to or from the table 11 by rotation of the frame 60 about the stem 61 by means of a further hydraulic cylinder 73.

One difference between the loading and unloading means is that the loading means 15 includes a plunger 74, biased downwardly away from a proximity sensor 75 by means of a coil spring 76. Rotation of an empty spool 20 by the alignment means shortly to be described, causes the plunger 74 to fall into an aperture 77 present in the spool flange 71. The engagement of the plunger 74 in the aperture 77 causes it to break contact with the proximity sensor 75 thereby signalling the alignment means to cease rotation of the spool.

Figure 11:
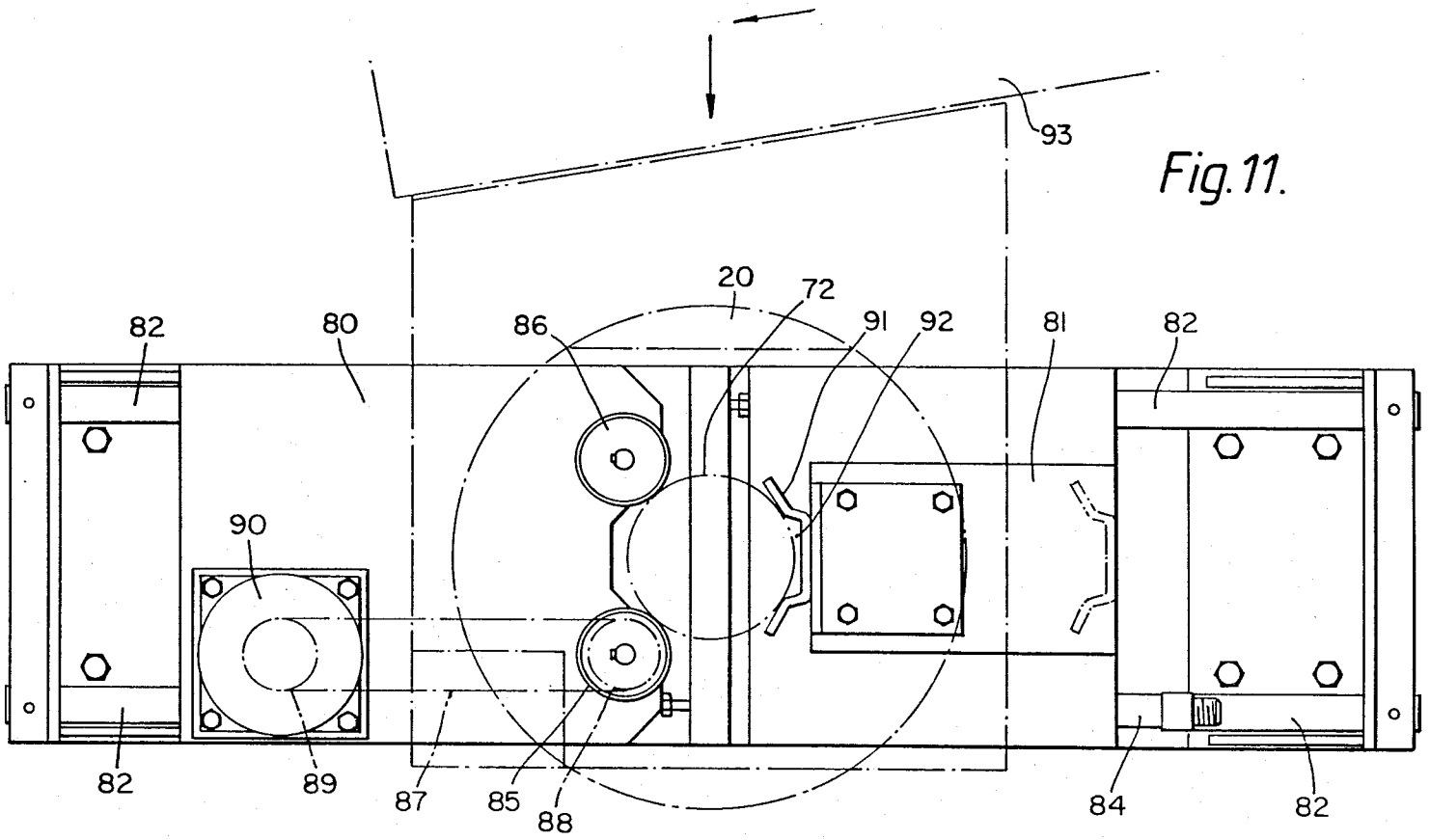
FIGS. 11 and 12 are plan and sectional side views respectively of alignment means adapted to align a spool before lifting by the spool loading means of FIGS. 9 and 10.
Figure 12:
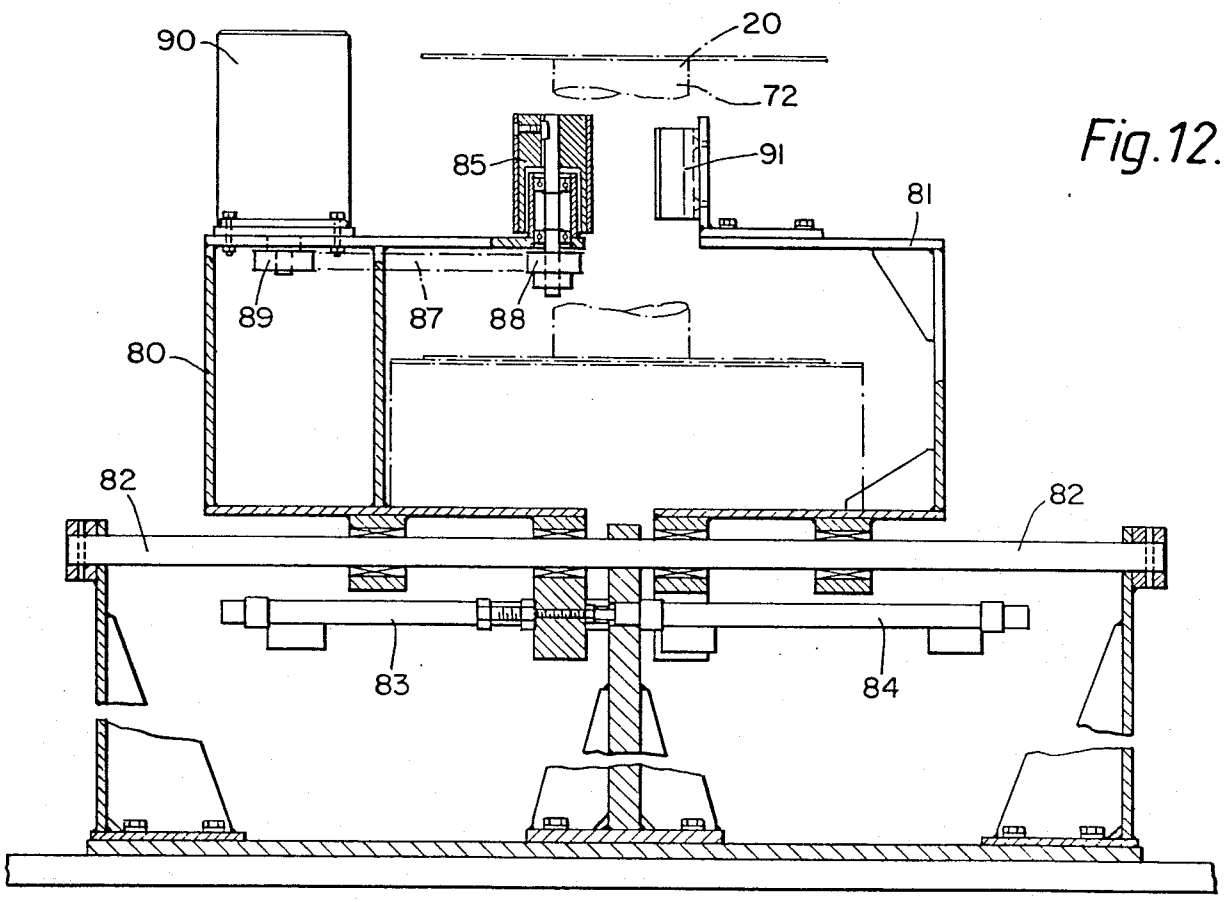

The alignment means for orienting a spool 20 prior to lifting on to the table 11 is shown in FIGS. 11 and 12. The alignment means comprises two frames 80 and 81, movable along a common pair of shafts 82 by means of hydraulic cylinders 83 and 84 repectively. One of the frames 80 carries a pair of rollers 85, 86, one drive roller 85 being driven by means of a belt 87 and pulleys 88, 89 from a motor 90. The other frame 81 carries a shaped bracket 91 having a central recess 92 in which may be received the barrel 72 of a spool 20.

In use a randomly aligned spool is fed from a conveyor system shown generally at 93 in FIG. 11, in the direction of the arrows. The hydraulic cylinders 83 and 84 move the frames 80, 81 inwardly so that the rollers 85, 86 contact the barrel of the spool, with the bracket 91 supporting the opposite side thereof. The spool is rotated by the drive roller 85 until the spring loaded plunger 74 (see FIG. 10) engages in the aperture 77, breaking contact with the proximity sensor 75 and stopping the drive from the motor 90. Thereafter the hydraulic cylinders 83 and 84 move the frames 80 and 81 outwardly so that the aligned spool may then be lifted on to the table by the spool loading means 15.

Figure 13:
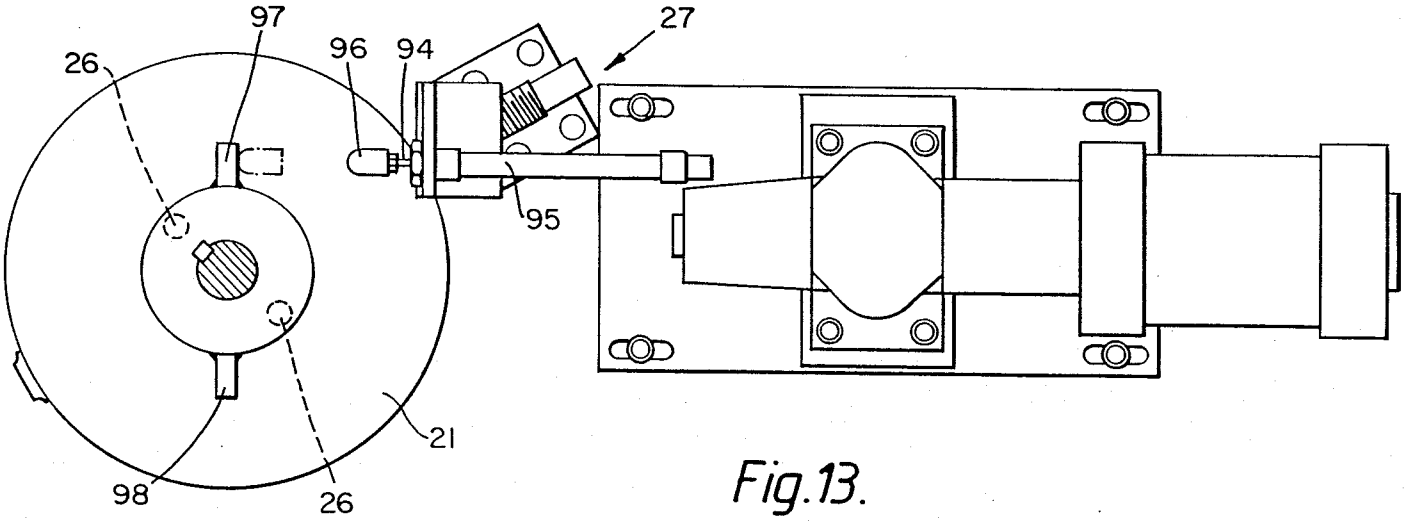
FIG. 13 is a schematic view of the winding station reset assembly shown in FIG. 3.

FIG. 13 shows the reset assembly 27, first described with reference to FIG. 3. The assembly 27 comprises a piston 94 slidably mounted in a cylinder 95 and having an enlarged head 96. When a mounting plate 21 enters the unloading position 14 it is slowly rotated by a belt and pulley system (not shown) until either one of two stop surfaces 97, 98, which are present on the underside of the mounting plate, engage the head 96 and depress the piston in the cylinder 95. This stops the belt and pulley drive, thereby halting the mounting plate 21 in an aligned position such that the pintles 26 thereon may receive an empty spool.

We claim:

1. Apparatus for winding cable on to a spool comprising a substantially horizontally mounted movable table; spool locating means for receiving at least three spools thereon with their longitudinal axes substantially vertically upright; means for rotating the table through at least three positions comprising: a loading position, a winding position and an unloading position; spool loading means for lifting an empty spool from a selected location in proximity to the table and loading the spool on to the spool locating means such that the axis of the spool is substantially vertically upright, the spool loading means being situated at the loading position; cable loading means for loading a cable on to an empty spool on the spool locating means, the cable loading means being situated at the winding position; spool winding means for rotating the spool locating means, the spool winding means being situated at the winding position for rotating the spool on the spool locating means and winding cable thereon; means for cutting the cable; and spool unloading means for lifting a spool from the spool locating means and for removing the spool to a second selected location, the spool unloading means being situated at the unloading position.

2. Apparatus according to claim 1 wherein the table is provided with at least three spool locating means in the form of rotatable mounting plates, each mounting plate including tapered pintles adapted to engage one said spools.

3. Apparatus according to claim 2 wherein the winding means comprises a motor, and a plate which is rotatably driven by the motor, the friction plate being engageable with the rotatable mounting plate disposed at the winding position.

4. Apparatus according to claim 1 wherein the cable loading means comprises a pivotable tube through which the cable passes, cable clamping means for clamping the cable and cable bending means for bending the cable, and wherein the spool is provided with an aperture, the pivotable tube being adapted to insert the bent cable through the aperture in the spool.

5. Apparatus according to claim 4 wherein the cable bending means comprises a pivotable bending arm moveable between an unengaged position substantially parallel to the longitudinal axis of the tube across the output end thereof, and an engaged position substantially perpendicular to the longitudinal axis of the tube thereby bending a portion of the free end of the cable.

6. Apparatus according to claim 1 wherein there is provided alignment means adapted to rotate the spool until it is in a predetermined rotationally aligned position.

7. Apparatus according to claim 6 wherein the alignment means comprises a drive means adapted to rotate the spool and a resiliently mounted plunger adapted to engage an aperture in the spool, and sensing means carried by the plunger, which sensing means disconnects the drive means when the plunger becomes engaged in the aperture.

8. An apparatus for winding cable sequentially onto each of a plurality of spools, each said spool comprising a longitudinal axis about which the cable is windable, said apparatus comprising:

a substantially horizontal table rotatable about a substantially vertical axis, said table comprising at least three spool mounts, each said spool mount being configured to receive one said spool with the longitudinal axis of said spool extending substantially vertically, each said spool mount being rotatable relative to said table about a substantially vertical axis;

table rotating means for selectively rotating the table;

spool loading means for selectively lifting one said spool from a selected location in proximity to said table and placing the spool onto a selected one of the spool mounts such that the axis of the spool is substantially vertical;

cable loading means for loading the caable onto one of said spools disposed on a second selected one of the spool mounts and for selectively rotating the second selected spool mount to wind the cable onto the spool;

cutting means for cutting the cable after a preselected amount of cable has been wound onto the spool; and spool unloading means for lifting one of said spools from a third selected one of the spool mounts and for removing said spool to a second selected location, whereby the table rotating means sequentially moves the table such that the spool mounts thereon are sequentially positioned for engagement by the spool loading means, the cable loading means and the spool unloading means and such that the spools mounted on said spool mounts have their axes aligned substantially vertically as the cable is wound thereon.

* * * * *